US005313217A

United States Patent [19]

Kakizawa

[11] Patent Number: 5,313,217

[45] Date of Patent: May 17, 1994

[54] WINDOW GLASS ANTENNA FOR A MOTOR VEHICLE

[75] Inventor: Hitoshi Kakizawa, Osaka, Japan

[73] Assignee: Nippon Sheet Glass Co., Ltd., Osaka, Japan

[21] Appl. No.: 727,485

[22] Filed: Jul. 9, 1991

[30] Foreign Application Priority Data

Jul. 16, 1990 [JP] Japan ..... 2-187769

[51] Int. Cl.[5] ..... H01Q 1/32

[52] U.S. Cl. ..... 343/713

[58] Field of Search ..... 343/713, 906, 850, 853, 343/858; H01Q 1/32

[56] References Cited

U.S. PATENT DOCUMENTS

| | | | |
|---|---|---|---|
| 4,003,056 | 1/1977 | Davis | 343/713 |
| 4,331,961 | 5/1982 | Davis | 343/713 |
| 4,727,377 | 2/1988 | Yotsuya et al. | 343/713 |
| 4,749,998 | 6/1988 | Yotsuya | 343/713 |
| 4,791,425 | 12/1988 | Yotsuya et al. | 343/713 |
| 4,823,140 | 4/1989 | Shibata et al. | 343/713 |
| 4,954,797 | 9/1990 | Shinnai et al. | 343/713 |
| 5,079,560 | 1/1992 | Sakurai et al. | 343/713 |

FOREIGN PATENT DOCUMENTS

| | | | |
|---|---|---|---|
| 3921413 | 3/1990 | Fed. Rep. of Germany | H01Q 1/32 |
| 0210705 | 9/1986 | Japan | H01Q 1/32 |
| 0132402 | 6/1987 | Japan | H01Q 1/32 |
| 269625 | 11/1988 | Japan . | |
| 197714 | 12/1988 | Japan . | |
| 0125102 | 5/1989 | Japan | H01Q 1/32 |

*Primary Examiner*—Michael C. Wimer
*Assistant Examiner*—Hoanganh Le
*Attorney, Agent, or Firm*—Woodcock, Washburn, Kurtz, Mackiewicz & Norris

[57] ABSTRACT

A antenna patterns each for a motor vehicle comprising a plurality of antenna patterns consisting of antenna conductors arranged on the corresponding window glasses of the motor vehicle. A connecting means (15) is provided for connecting the antenna patterns in parallel with each other for mixing reception outputs of the antenna patterns. The connecting means is a high-frequency cut coil for cutting off the high frequency component to be received from one of the antenna patterns to couple the plural outputs of the antenna patterns only within the low frequency band.

7 Claims, 5 Drawing Sheets

WINDOW GLASS ANTENNA FOR A MOTOR VEHICLE

BACKGROUND OF THE INVENTION

1. Field of the Invention

This invention relates to a antenna patterns for a motor vehicle and, more particularly, a antenna patterns for a motor vehicle, wherein reception sensitivity of an AM broadcast wave is improved.

2. Description of the Prior Art

There is conventionally known a window glass antenna for a motor vehicle using, as radio reception antenna wires, a plurality of defogging heater wires additionally formed on the inner surface of a rear window of the motor vehicle.

The reception sensitivity of the AM (medium frequency band) antenna patterns is determined by the area of glass. That is, the conductor pattern area of the window glass antenna is determined by the glass area. The glass area is almost determined by an outline of the motor vehicle. Therefore, a motor vehicle having a small glass area has low reception sensitivity .

According to prior art techniques, a preamplifier is arranged between a car radio and the window glass antenna to amplify a reception output, or an impedance converter is arranged to establish matching, thereby reducing a transmission loss.

FIG. 7 shows such a conventional arrangement including a preamplifier. Electrodes 72 to 74 are formed on a rear window glass 71. Heater wires 75 are connected between the electrodes 72 and 73 and between the electrodes 72 and 74. The electrode 73 is grounded to the vehicle body and is connected to the ground input of a preamplifier 79. A heating current is supplied to the electrode 74 which is connected to the input terminal of the preamplifier 79.

The preamplifier 79 increases a reception output from the electrode 74 to a predetermined level, the output of which is supplied to a car radio 77 through a coaxial cable 76 whose outer braided conductor is grounded. Reference numeral 78 denotes a loudspeaker connected to the car radio 77.

FIG. 8 shows a system arrangement of another conventional example having an impedance converter. The same reference numerals as in FIG. 7 denote the same parts in FIG. 8. Referring to FIG. 8, a reception output from an electrode 74 is supplied to a car radio 77 through an impedance converter 80 and a coaxial cable 76.

Heater wires 75 exhibit a high impedance state in the AM broadcast wave band. The impedance converter 80 converts an impedance of the heater wires 75 serving as an antenna to match with that of the coaxial cable 76. By this impedance matching, reception outputs from the electrodes 73 and 74 are supplied to the car radio 77 with a low transmission loss.

In the above prior art, preamplifier or impedance converter necessarily increases the components of a window antenna system of a motor vehicle. When the window glass antenna for the motor vehicle is placed in a strong electric field, the reception signal is distorted due to saturation of the preamplifier. In addition, even if the impedance converter is arranged, a motor vehicle having a small glass area cannot have a sufficient reception sensitivity.

SUMMARY OF THE INVENTION

It is an object of the present invention to provide a window glass antenna for a motor vehicle, which solves the conventional problems described above and can obtain a sufficient AM reception sensitivity in a motor vehicle having a small glass area.

According to an aspect of the present invention, there is provided a window glass antenna for a motor vehicle, comprising a plurality of antenna patterns each consisting of antenna conductors arranged on the corresponding window glasses of the motor vehicle, and connecting means which connects the antenna patterns in parallel with each other for mixing reception outputs of the antenna patterns .

According to another aspect of this invention, the connecting means comprises the high-frequency cut coil for cutting off the high-frequency component to be received from one of the antenna patterns, a high frequency component from another one of the of the antenna patterns being derived via the connecting means and low frequency components from the window glass antenna being coupled and derived via the connecting means.

According to another aspect of this invention, one of the antenna patterns comprises a phase adjustment conductor element for adjusting the phase of a reception component therefrom in phase with the remaining antenna patterns with respect to an FM broadcast band.

When the connecting means connects the plurality of the antenna patterns in parallel with each other, the total area of the antenna patterns is increased, and the effective length of the antenna conductors is increased, thereby increasing a reception sensitivity for an AM wave having a long wavelength.

In this case, upon FM broadcast reception, the phase of an FM reception output having a short wavelength of each of the antenna patterns influences reception sensitivity . For this reason, the high-frequency cut coil cuts FM reception outputs of the antenna patterns except for one. Alternatively, the phase adjusting conductor element may adjust FM reception outputs from the antenna patterns in phase so as to allow a maximum FM reception sensitivity.

The above, and other, objects, features and advantages of the present invention, will become readily apparent from the following detailed description thereof which is to be read in connection with the accompanying drawings.

DETAILED DESCRIPTION OF PREFERRED EMBODIMENTS

Figure 1:
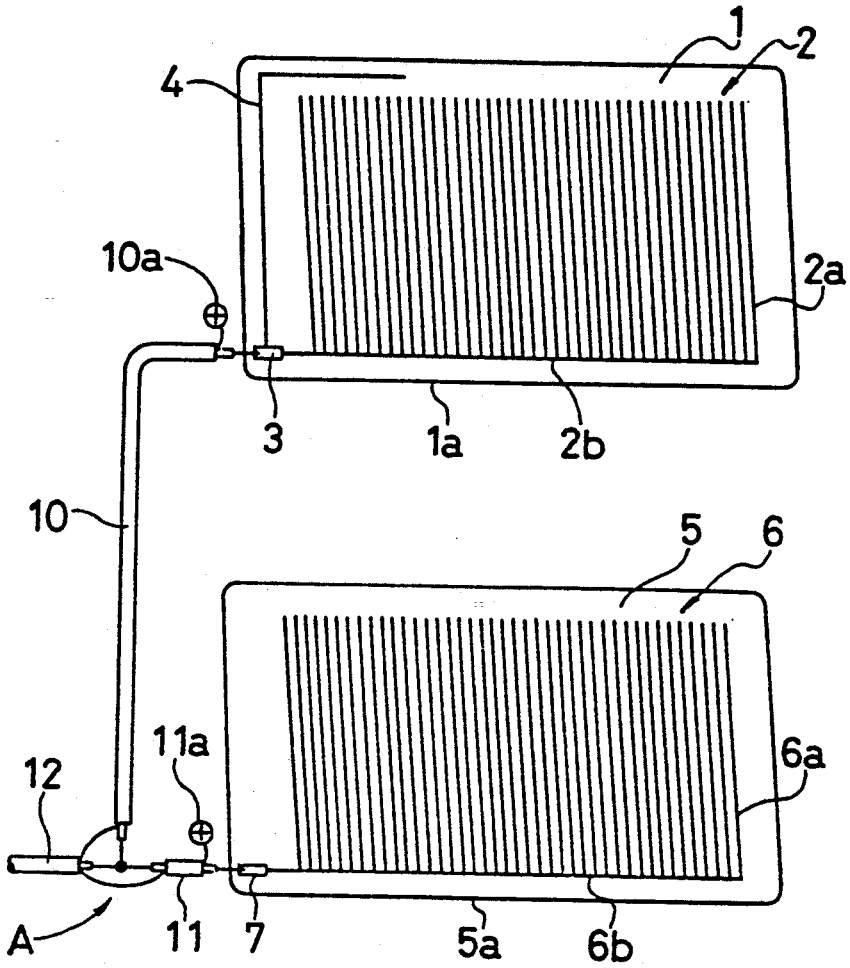
FIG. 1 is a view showing a window glass antenna for a motor vehicle according to the first embodiment of the present invention.

FIG. 1 is a view showing an arrangement of a window glass antenna for a motor vehicle according to the first embodiment of the present invention.

Referring to FIG. 1, reference numeral 1 denotes a right window glass fitted in a rear right portion (rear quarter window) as a ¼ side portion of the motor vehicle. A radio reception antenna conductor pattern 2 and a phase adjusting conductor element 4 are formed on the right window glass 1 by printing and baking conductive paste material on the window.

The comblike antenna pattern 2 is generally formed of vertical elements which have a high sensitivity for V-polarized FM wave components. The antenna pattern 2 is an open-circuted antenna consisting of antenna elements 2*a* and 2*b*. The antenna element 2*b* is a horizontal member aligned along an edge 1*a* of the right window glass 1 and extends form a power feed point 3. A plurality of antenna elements 2*a* serving as vertical antenna members are connected to the antenna element 2*b*. In this embodiment, 41 antenna elements 2*a* are arranged at a pitch 20 mm, and the length of each antenna element 2*a* is 380 mm.

The right end antenna element 2*a* of the antenna pattern 2 is spaced apart from the edge 1*a* by 50 mm. The upper end of each antenna element 2*a* is spaced apart from the edge 1*a* by 50 mm.

The L-shaped phase adjusting conductor element 4 consists of horizontal and vertical members, as shown in FIG. 1, and extends from the power feed point 3 along the left edge 1*a* of the right window glass 1. The horizontal and vertical members of the phase adjusting conductor element 4 are spaced apart from the edge 1*a* by 10 mm.

Reference numeral 5 in FIG. 1 denotes a left window glass fitted in the rear left quarter window of the motor vehicle. A radio reception antenna conductor pattern 6 is formed on the left window glass 5 by printing and baking conductive paste material on the window. The comblike antenna pattern 6 consists of antenna elements 6*a* and 6*b* and is arranged the same manner as the antenna pattern 2. The antenna element 6*b* is a horizontal member extending form a power feed point 7 along an edge 5*a* of the left window glass 5.

The power feed point 3 is connected to a coaxial cable 10, and the power feed 7 is connected to a coaxial cable 11. The coaxial cable 10 and 11 are connected to a coaxial cable 12 at a connecting point A located near the left window glass 5. The coaxial cable 12 is connected to an AM/FM car radio (not shown). Braided outer wires of the coaxial cable 10 on the power feed point 3 side and braided outer wires of the coaxial cable 11 on the power feed point 7 side are grounded to the vehicle body through corresponding screws 10*a* and 11a. The braided wires of the coaxial cables 10 and 11 on the coaxial cable 12 side are connected to the braided wires of the coaxial cable 12.

As shown in FIG. 1, two window glasses 1 and 5 are employed for antenna conductors, so that the total area of the antenna conductor patterns can be increased, which increases AM reception sensitivity. The phase of the reception output appearing at the power feed point 3 is adjusted in phase with that of the reception output appearing at the power feed point 7 so that the FM reception sensitivity is also increased. The length of the phase adjusting conductor element 4 is determined to increase the FM sensitivity.

Figure 2:
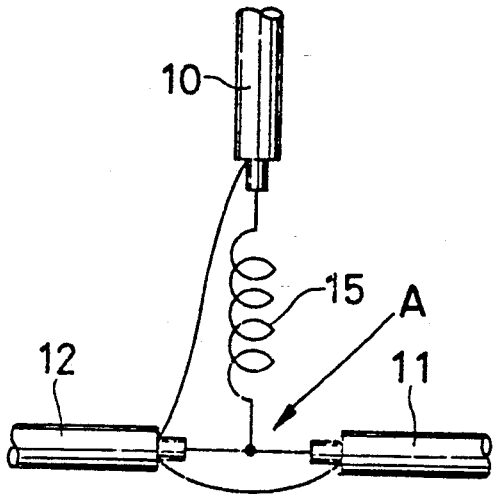
FIG. 2 is a view for explaining the second embodiment of the present invention.

FIG. 2 is a view for explaining a window glass antenna for a motor vehicle according to the second embodiment of the present invention.

Reference numeral 15 in FIG. 2 denotes an FM cut coil for cutting off an FM reception output. The same reference numerals as in FIG. 1 denote the same parts in FIG. 2. Although not shown, the antenna on the right window glass 1 shown in FIG. 1 is connected to a coaxial cable 10, and the antenna on the left window glass 5 shown in FIG. 1 is connected to a coaxial cable 11. A phase adjusting conductor element 4 is formed on the right window glass 1. The antenna conductor pattern of the right window glass 1 is identical with that of the left window glass 5.

Referring to FIG. 2, the coaxial cable 10 is connected to the coaxial cables 11 and 12 through an FM cut coil 15. The FM cut coil has an inductance of several $\mu$H (e.g., 5 $\mu$H) and becomes in a high impedance state with respect to an FM component (FM reception output) of the reception output appearing at a power feed point 3. Therefore, the reception output of the FM component is transmitted from only the power feed paint 7 to the coaxial cable 12.

As is apparent from FIG. 2, the antennas on two window glasses 1 and 5 are used in parallel and coupled through the FM cut coil 15. Therefore, in AM reception, the area of the antenna conductor patterns can be increased so that the AM reception sensitivity is increased. In FM reception, a reception output is transmitted from only the left window glass 5 to the coaxial cable 12. Therefore, FM tuning process for the conductive pattern can be simplified.

The FM cut coil 15 is inserted on the coaxial cable 10 because the coaxial cable 10 is longer than the coaxial cable 11 and has a larger transmission loss.

Figure 3:
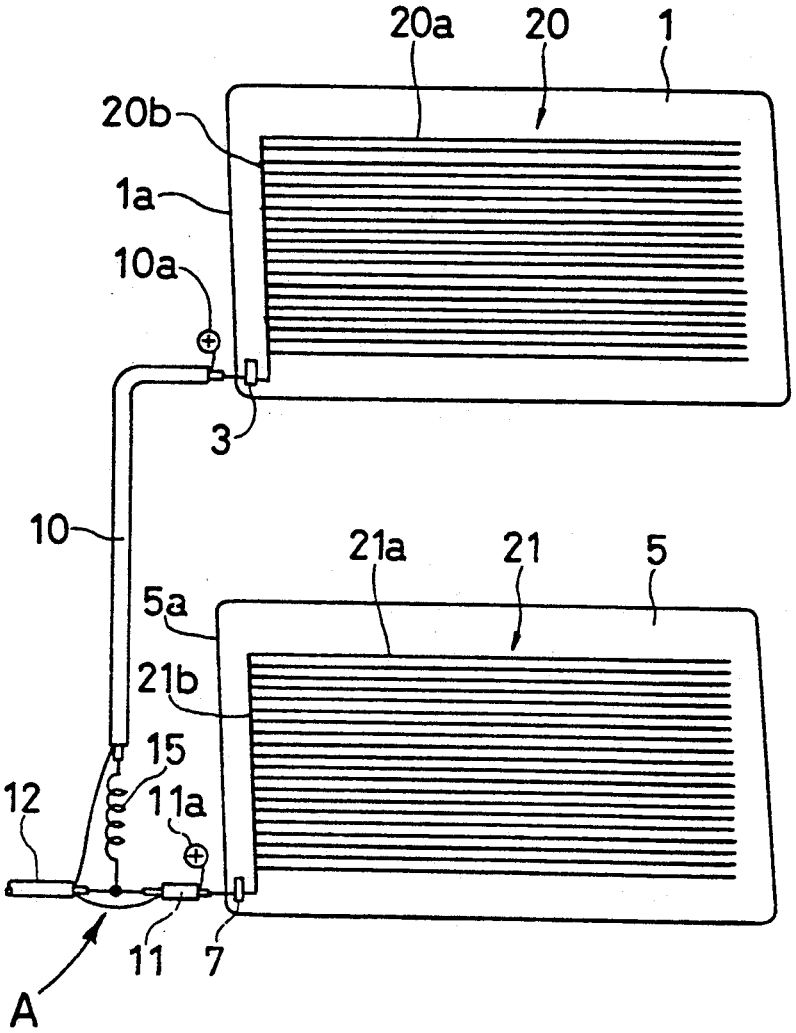
FIG. 3 is a view showing the third embodiment of the present invention.

FIG. 3 is a view showing a window glass antenna for a motor vehicle according to the third embodiment of the present invention. The same reference numerals as in FIG. 1 denote the same parts in FIG. 3.

A comblike radio reception antenna pattern 20 is formed by printing and baking conductive paste material on a right window glass 1 fitted in the right rear quarter window. The antenna pattern 20 has horizontal elements having a higher sensitivity for H-polarized FM wave components. The antenna pattern 20 is an open-circuited antenna pattern consisting antenna elements 20*a* and 20*b*.

The antenna element 20*b* is a vertical member extending from a power feed point 3 along an edge 1*a* of the right window glass 1. A plurality of antenna elements 20*a* serving as horizontal antenna members extend form the antenna element 20*b*. In this embodiment, 20 antenna elements 20*a* are arranged at a pitch of 20 mm, and the length of each antenna element 20*a* is 800 mm.

A comblike pattern 21 is formed on a left window glass 5 fitted in the left rear quarter window. This antenna pattern 21 consists of antenna elements 21*a* and 21*b* and has the same conductor pattern as that of the antenna pattern 20. The antenna element 21*b* vertically extends from a power feed point 7 along an edge 5*a* of the left window glass 5.

The power feed point 3 is connected to a coaxial cable 10, and the power feed point 7 is connected to a coaxial cable 11. The coaxial cable 10 is connected to the coaxial cable 12 through an FM cut coil 15. The FM cut coil 15 has an inductance of several μH (e.g., 5 μH) and becomes in a high impedance state with respect to an FM reception output appearing at the power feed point 3. The FM reception output is transmitted from only the power feed point 7 to the coaxial cable 12.

As is apparent from FIG. 3, the antennas on two window glasses 1 and 5 are used in parallel and coupled through the FM cut coil 15. Therefore, in AM reception, the area of the antenna conductor patterns can be increased and the AM reception sensitivity is increased. In FM reception, a reception output is transmitted from only the left window glass 5 to the coaxial cable 12, and AM/FM car radio (not shown).

Figure 4:
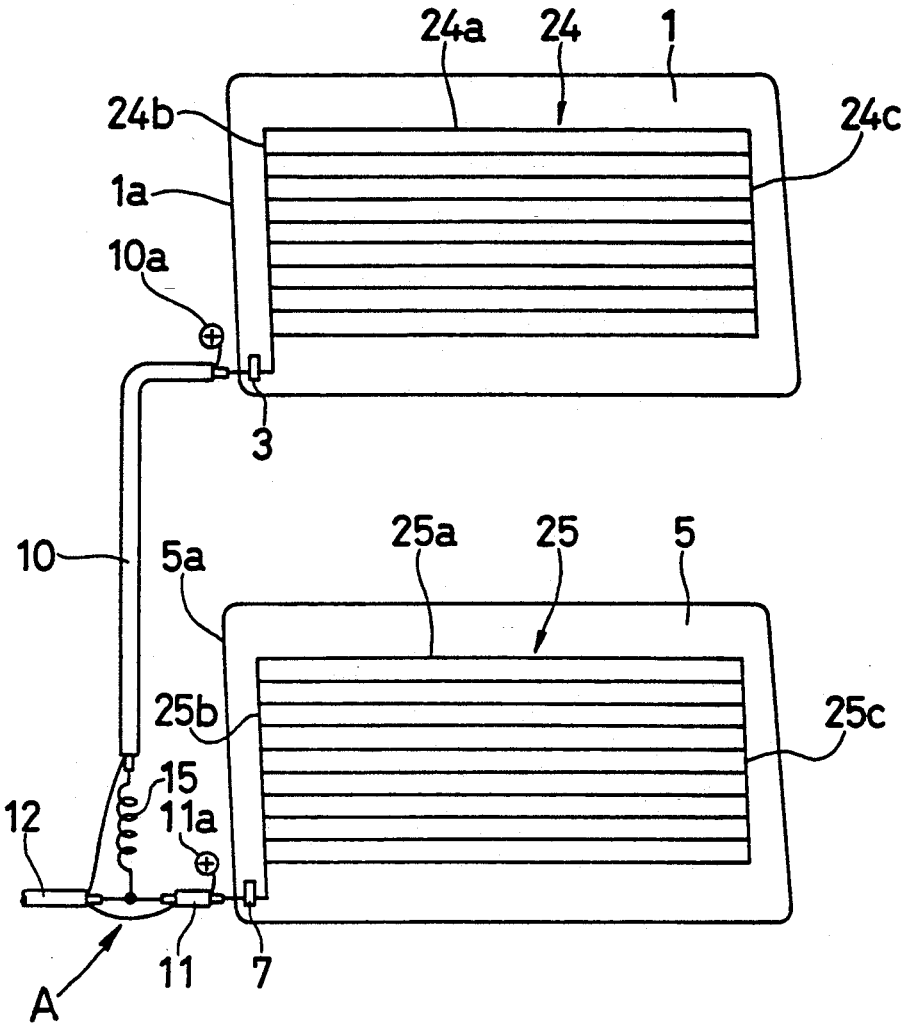
FIG. 4 is a view showing the fourth embodiment of the present invention.

FIG. 4 is a view showing a window glass antenna for a motor vehicle according to the fourth embodiment of the present invention. The same reference numerals as in FIG. 3 denote the same parts in FIG. 4.

A grid-shaped radio reception antenna conductor pattern 24 is formed on a right window glass 1. The antenna pattern 24 consists of antenna elements 24*a* to 24*c*. The antenna element 24*b* is a vertical member extending from a power feed point 3 along an edge 1*a* of the right window glass 1. A plurality of antenna elements 24*a* serving as horizontal members extend from the antenna element 24*b*. The antenna element 24*c* serves as a vertical member which contacts the right ends of the antenna elements 24*a* and extends along the edge 1*a*.

Figure 7:
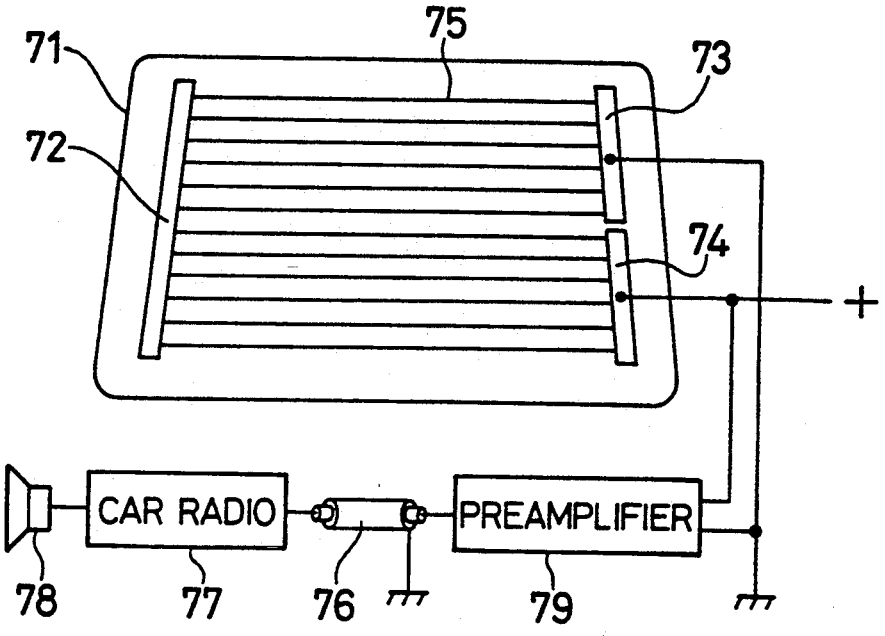
FIG. 7 PRIOR ART
FIG. 7 is a view showing the first conventional system.
Figure 8:
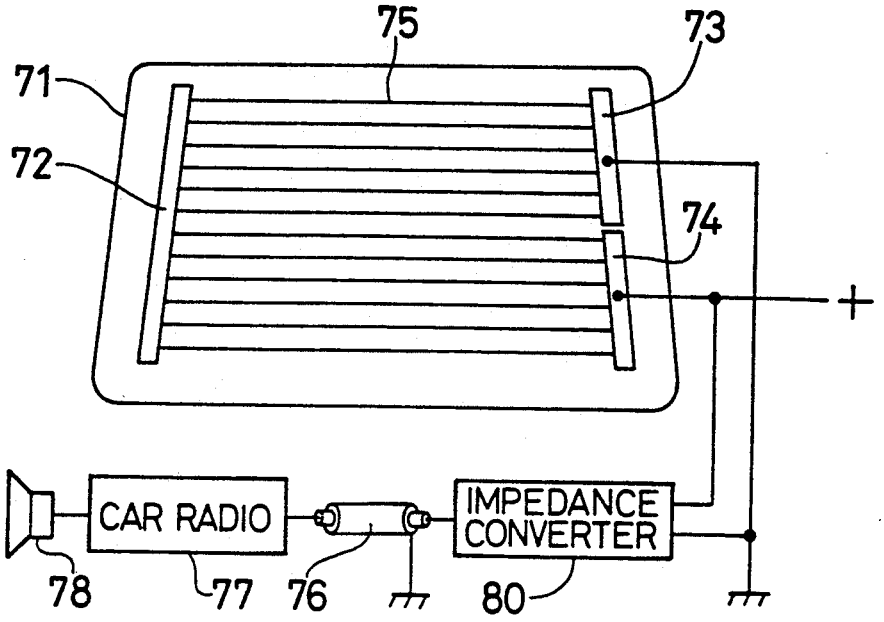
FIG. 8 PRIOR ART
FIG. 8 is a view showing the second conventional system.

A grid-shaped antenna conductor pattern 25 is formed on a left window glass 5. This antenna pattern 25 consists of antenna elements 25*a* and 25*c* and has the same conductor pattern as that of the antenna pattern 24. The antenna element 25*b* is a vertical member vertically extending form a power feed point 7 along an edge 5*a* of the left window glass 5. The antenna element 25*c* is a vertical member which contacts the right ends of the antenna elements 25*a* serving as horizontal members and extends along the edge 5*a*. The grid-shaped antenna patterns 24 and 25 are free from the conventional heater wires 75 as shown in FIGS. 7 and 8.

Connections of coaxial cables 10, 11 and 12, and an FM cut coil 15 are the same as those in FIG. 3.

As is apparent from FIG. 4, the antennas on two window glasses 1 and 5 are used in parallel and coupled through the FM cut coil 15. Therefore, in AM reception, the area of the antenna conductor patterns can be increased so that the AM reception sensitivity is increased. An increase in AM reception sensitivity is shown in the frequency-antenna gain characteristic graph in FIG. 5.

Figure 5:
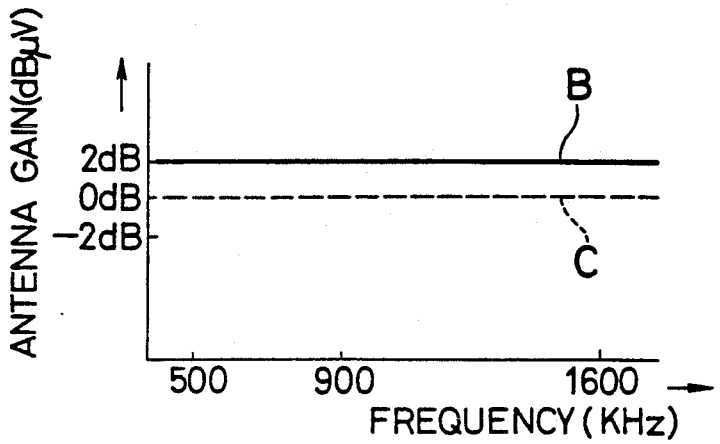
FIG. 5 is a graph showing frequency-antenna gain characteristic according to the fourth embodiment of the present invention.

Referring to FIG. 5, the frequency (unit: KHz) is plotted along the abscissa, and the antenna gain (unit: dBμV) is plotted along the ordinate. A dotted line C in FIG. 5 represents an antenna gain obtained by either the antenna pattern 24 or the antenna pattern 25. A solid line B in FIG. 5 represents an antenna gain obtained by both antenna patterns 24 and 25. When the gain represented by the dotted line C is used as a reference gain, i.e., 0 dBμV, an antenna gain is apparently increased by 2 dBμV, as indicated by the solid line B.

In FM reception, a reception output from only the left window glass 5 is transmitted to the coaxial cable 12.

Figure 6:
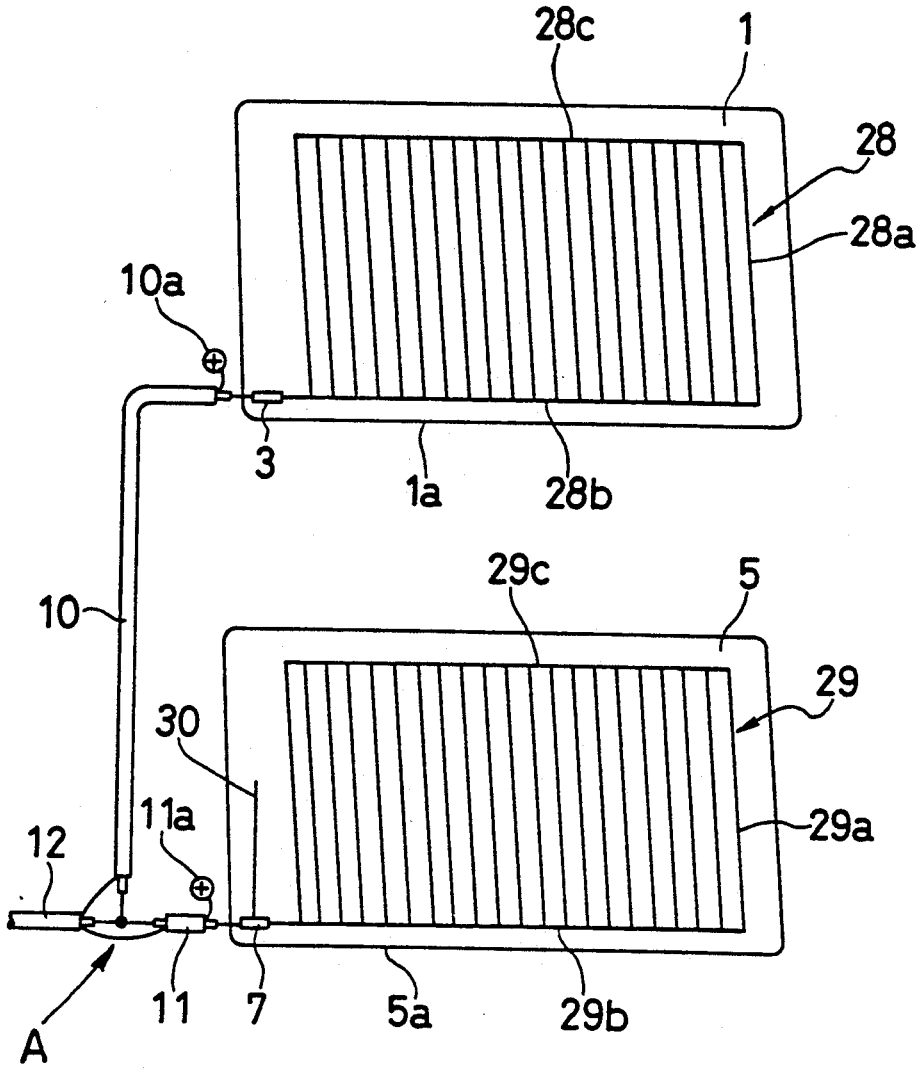
FIG. 6 is a view showing the fifth embodiment of the present invention.

FIG. 6 is a view showing a window glass antenna for a motor vehicle according to the fourth embodiment of the present invention. The same reference numerals as in FIG. 1 denote the same parts in FIG. 6.

A grid-shaped radio reception antenna conductor pattern 28 is formed on a right window glass 1. The antenna pattern 28 consists of antenna elements 28*a* to 28*c*. The antenna element 28*b* is a horizontal member extending from a power feed point 3 along an edge 1*a* of the right window glass 1. A plurality of antenna elements 28*a* serving as vertical members extend from the antenna element 28*b*. The antenna element 28*c* serves as a horizontal member which contacts the upper ends of the antenna elements 28*a* and horizontally extends along the edge 1*a*.

A grid-shaped antenna conductor pattern 29 and a phase adjusting conductor element 30 are formed on a left window glass 5. The antenna pattern 29 consists of antenna elements 29*a* and 29*c* and has the same conductor pattern as that of the antenna pattern 28. The antenna element 29*b* is a horizontal member extending form a power feed point 7 along an edge 5*a* of the left window glass 5. The antenna element 29*c* is a horizontal member which contacts the upper ends of the antenna elements 29*a* serving as vertical members and extends along the edge 5*a*.

The grid-shaped antenna patterns 28 and 29 are also free from the conventional heater wires 75 as shown in FIGS. 7 and 8.

The phase adjusting conductor element 30 consists of a vertical member, as shown in FIG. 6, and extends from the power feed point 7 along the left edge 5*a* of the left window glass 1. The phase adjusting conductor element 30 is used to increase the FM reception sensitivity and adjusts the phase of the reception output appearing at the power feed point 7. The phase can be adjusted by adjusting the length of the phase adjusting conductor element 30.

The connections of coaxial cables 10, 11, and 12 are the same as those in FIG. 1.

As is apparent from FIG. 6, antennas on the two window glasses 1 and 5 are employed in parallel, so that a total area of the antenna conductor patterns can be increased to increase AM reception sensitivity. In addition, the phase of the reception output appearing at the power feed point 3 is adjusted by the phase adjusting conductor 30 in phase with that of the reception output appearing at the power feed point 7 so that the FM reception sensitivity is also increased.

Since the coaxial cable 11 is shorter than the coaxial cable 10, it is easier to change the phase of FM reception wave by varying the length of the phase adjusting conductor element 30 on the glass window 5 having the antenna conductor connected to the shorter coaxial cable 11.

In the embodiment shown in FIGS. 1 and 6, the phase adjusting conductor elements 4 and 30 are connected to the power feed points 3 and 7, respectively. However, the phase adjusting conductor elements 4 and 30 may be connected to corresponding ones of the antenna elements of the antenna patterns. The phase adjustment can be facilitated when the phase adjusting conductor elements 4 and 30 are connected to the power feed points 3 and 7.

In each embodiment described above, the right and left window glasses 1 and 5 are fitted in the corresponding windows. However, the window glasses 1 and 5 may be openable using hinge mechanisms or may be vertically openable.

In each embodiment described above, the antenna conductor pattern of the right window glass 1 is identical with that of the left window glass 5. However, the antenna pattern of the right window glass 1 may be different from that of the left window glass 5.

In each embodiment described above, the antenna conductor patterns are formed on the two window glass 1 and 5 which are then used in parallel to each other. However, antenna patterns may be formed on three or more window glasses which are used in parallel.

The window glass antenna according to the present invention shows a sufficient AM reception sensitivity for a motor vehicle having a small glass area without any preamplifier or impedance converter.

What is claimed is:

1. A window glass antenna for a motor vehicle, comprising:

a plurality of separate window glasses in said motor vehicle, a plurality of separate antenna patterns, each said pattern consisting of antenna conductors arranged on a respective window glass, connecting means disposed between said antenna patterns for mixing reception outputs of said antenna patterns through paths which connect said antenna patterns, one of said paths including an FM cut/AM pass coil for filtering out an FM frequency reception component and passing an AM frequency reception component from a first predetermined antenna pattern, another of said paths for passing said FM and AM frequency reception components.

2. A window glass antenna according to claim 1, wherein said antenna conductors consist of a horizontal element and a plurality of vertical elements extending from said horizontal element.

3. A window glass antenna according to claim 1, wherein said antenna conductors consist of a vertical element and a plurality of horizontal elements extending from said vertical element.

4. A window glass antenna according to claim 1, wherein said antenna conductors consist of two parallel horizontal elements and a plurality of vertical elements extending between said two parallel horizontal elements.

5. A window glass antenna according to claim 1, wherein said antenna conductors consist of two parallel vertical elements and a plurality of horizontal elements extending between said two parallel vertical elements.

6. A window glass antenna according to claim 1, wherein said separate windows are rear quarter windows.

7. A window glass antenna according to claim 6, wherein said antenna conductors are arranged on said quarter windows.

* * * * *